US006423889B2

(12) United States Patent
Inoue

(10) Patent No.: US 6,423,889 B2
(45) Date of Patent: Jul. 23, 2002

(54) REGULATING BUTTON MECHANISM FOR EASILY REGULATING ESCAPE TIMING, SILENT SYSTEM COOPERATIVE THEREWITH AND KEYBOARD MUSICAL INSTRUMENT EQUIPPED THEREWITH

(75) Inventor: Satoshi Inoue, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/859,760

(22) Filed: May 17, 2001

(30) Foreign Application Priority Data

May 19, 2000 (JP) ..... 12-148717

(51) Int. Cl.[7] ..... G10C 3/18

(52) U.S. Cl. ..... 84/236; 84/171; 84/243; 84/719; 84/744

(58) Field of Search ..... 84/17–20, 236, 84/243–244, 247–250, 170–171, 600, 621, 718–720, 743–745

(56) References Cited

U.S. PATENT DOCUMENTS 5,428,186 A * 6/1995 Kaneko et al. ..... 84/719
5,511,454 A * 4/1996 Jones et al. ..... 84/236
5,545,839 A * 8/1996 Kamamura et al. ..... 84/171
5,565,636 A * 10/1996 Sugiyama ..... 84/171
5,874,687 A * 2/1999 Kawamura ..... 84/719
5,911,167 A * 6/1999 Jones et al. ..... 84/236

* cited by examiner

*Primary Examiner*—Marlon T. Fletcher
(74) *Attorney, Agent, or Firm*—Morrison & Foerster LLP

(57) ABSTRACT

A silent piano includes a hammer stopper changed between a free position out of the trajectories of hammer shanks and a blocking position on the trajectories for blocking strings from being struck with the hammers and a tandem regulating button mechanism having standard regulating buttons and regulating bars used together with the hammer stopper changed in the blocking position for changing escaping speed of jacks, and an adjusting mechanism is provided between the regulating bars and a shaft for adjusting the regulating bars to appropriate angular positions, wherein the adjusting mechanism has regulating screws projecting from stationary brackets fixed to the shaft into a free space created in front of the array of action mechanisms so that a tuner easily adjusts the regulating bars to the appropriate angular positions without removing the action mechanisms from on the key bed.

25 Claims, 10 Drawing Sheets

REGULATING BUTTON MECHANISM FOR EASILY REGULATING ESCAPE TIMING, SILENT SYSTEM COOPERATIVE THEREWITH AND KEYBOARD MUSICAL INSTRUMENT EQUIPPED THEREWITH

FIELD OF THE INVENTION

This invention relates to a keyboard musical instrument and, more particularly, to a regulating button mechanism, a silent system cooperative therewith and a keyboard musical instrument.

DESCRIPTION OF THE RELATED ART

A silent piano is fabricated on the basis of an acoustic piano, and is fallen within the scope of the keyboard musical instrument. The silent piano is a combination of an acoustic piano, a silent system and an electronic sound generating system. A standard upright piano or a standard grand piano is available for the silent piano. Therefore, a keyboard, action mechanisms, hammer assemblies, dampers and strings are incorporated in the acoustic piano.

The electronic sound generating system includes key/hammer sensors, a data processing system, a tone generator and a sound system. The key/hammer sensors monitor the keys and/or hammers, and supply key/hammer position signals representative of current key/hammer positions to the data processing system. The data processing system periodically checks the key/hammer position signals to see whether or not any one of the keys and hammers changes the current position from the previous position. If a key/hammer has changed the current position, the data processing system specifies the key/hammer, and determines the velocity. A key code assigned to the key/hammer and the velocity are stored in music data codes together with instructions, and the music data codes are supplied to the tone generator at appropriate timing. The tone generator produces an audio signal from the music data codes, and a headphone converts the audio signal to an electronic tones. Thus, the electronic sound generating system generates electronic tones in response to the fingering on the keyboard.

The silent system includes a hammer stopper provided between the hammer assemblies and the strings, and the hammer stopper is changed between a free position and a blocking position. When the hammer stopper is staying at the free position, the hammer stopper is out of the trajectories of the hammer assemblies, and the strings are selectively struck with the hammer assemblies in response to the fingering on the keyboard. The strings vibrate so as to generate piano tones. However, when the hammer stopper is changed to the blocking position, the hammer stopper is moved into the trajectories of the hammer assemblies. Although the escape of jacks give rise to free rotation of the hammer assemblies, the hammer assemblies rebound on the hammer stopper before striking the strings, and any piano tone is not generated through the vibrations of the strings. Thus, a pianist can practice the fingering without disturbance to the neighborhood, and the silent piano is popular to the pianists who live in downtown areas of cities.

Although the hammer stopper is simply moved between the free position and the blocking position, i.e., out of the trajectories of the hammer assemblies and on the trajectories of the hammer assemblies, it is not easy for the manufacturer to adjust the hammer stopper to the most appropriate position in the narrow space between the hammer assemblies and the strings. This is because of the fact that the jacks escape from the associated hammer assemblies at a short distance between the hammer assemblies and the strings. The escape points are adjusted by regulating the distance between the hammer assemblies and the strings to a predetermined value under the condition that a tuner slowly depresses the associated keys. The predetermined value is of the order of 2 milliters in standard grand pianos. This means that the manufacturer is to install the hammer stopper in the extremely narrow space accurately. If the hammer stopper is too close to the hammer assemblies at the rest positions, the hammer assemblies are pinched between the jacks and the hammer stopper in the blocking position before the escape.

It is effective against the pinch to make the time to escape from the hammers earlier than usual. The escape takes place when the toe of the jack is brought into contact with the regulating button. The time to escape from the hammer is made earlier by decreasing the distance between the toe and the regulating button. However, the escape deeply concerns key touch unique to the acoustic piano. If the manufacturer advances the escape from the usual timing, the unique piano key touch is destroyed. For this reason, the regulation of the escape time is less desirable.

A tandem regulating button mechanism was proposed in order to change the escape point depending upon the position of the hammer stopper. FIG. 1 shows the prior art tandem regulating button mechanism. In FIG. 1, the "front" is the right side, and the "rear" is the left side. A key, an action mechanism, a hammer assembly, a string and a tandem regulating button mechanism 5 are labeled with reference numerals 1, 2, 3, 4 and 5, respectively. The action mechanism 2 is held in contact with the key 1 by means of a capstan screw 2*a*, and the hammer assembly 3 is driven for free rotation by the action mechanism 2. The action mechanism 2, the hammer assembly 3 and the tandem regulating button mechanism 5 are supported by action brackets 6*a*, and, accordingly, the action mechanism 2, the hammer assembly 3 and the tandem regulating button mechanism 5 assembled with the action brackets are hereinbelow referred to as "action bracket assembly".

The action mechanism 2 includes a whippen flange 2*b*, a whippen assembly 2*c*, a jack 2*d*, a repetition lever 2*e* and a repetition spring 2*f* The whippen flange 2*b* is fixed to a whippen rail 2*g*, which is supported by the action brackets 6*a*. The whippen assembly 2*c* is rotatably connected to the whippen flange 2*b* at the rear end thereof, and forwardly projects from the whippen flange 2*b*. The jack 2*d* has an L-letter shape, and has a leg portion 2*h* and a foot portion 2*j*. The jack 2*d* is rotatably connected at a bend portion to the front end portion of the whippen assembly 2*c*, and the leg portion 2*h* is inserted into a hole formed in the repetition lever 2*e*. A toe 2*k* and a bump 2*m* are formed in the foot portion 2*j*, and the bump 2*m* is closer to the bent portion than the toe 2*k* .

The prior art tandem regulating button mechanism 5 includes a regulating rail 5*a*, a plurality of first regulating buttons 5*b*, a plurality of second regulating buttons 5*c* and a shaft 5*d*. A shank flange rail 6*b* is supported by the action brackets 6*a*, and the regulating rail 5*a* is screwed to the shank flange rail 6*b*. The first regulating buttons 5*b* are hung from the regulating rail 5*a*, and are directed to the toes 2*k* of the associated jacks 2*d*. Each of the first regulating buttons 5*b* is rotatable around the center axis of a screw 5*e* so as to vary the gap between the toe 2*k* and the lower end surface thereof. On the other hand, the second regulating buttons 5*c* are connected to the shaft 5*d* by means of screws 5*f*, and the shaft 5*d* is rotatably supported by the action brackets 6*a*. The shaft 5*d* is connected to a driving mechanism (not shown), and the second regulating buttons 5*c* are swingable around the center axis of the shaft 5*d*. The second regulating buttons 5*c* are changed between the first angular position and the second angular position. When the hammer stopper 7 is changed to the free position, the second regulating buttons 5*c* are changed to the first angular position, and are moved out of the trajectory of the bump 2*m*. On the other hand, when the hammer stopper 7 is changed to the blocking position, the second regulating buttons 5*c* are changed to the second angular position, and the second regulating buttons 5*c* are moved into the trajectory of the bump 2*m*. The prior art tandem regulating button mechanism is advantageous in that the jack 2*d* escapes from the hammer assembly 3 at different speed between the two modes of operation. The toe 2*k* and the bump 2*m* are concurrently brought into contact with the first regulating button 5*b* and the second regulating button 5*c*, and the jack starts the escape at the same timing. However, the bump 2*m* and the second regulating button 5*c* give rise to the rotation of the jack 2*d* at higher speed. Because, the reaction at the bump 2*m* causes the jack 2*d* to turn over a larger angle. This results in early completion of the escape. For this reason, the hammer assembly 3 is less pinched between the jack 2*d* and the hammer stopper 7. Thus, the prior art tandem regulating button mechanism is effective against the hammer assembly 3 pinched between the jack 2*d* and the hammer stopper 7 without destruction of the unique piano key touch. However, a tuner feels it complicated to adjust the prior art tandem regulating button mechanism to the optimum escape timing. This is because of the fact that the tuner needs repeatedly moving the action bracket assembly from and onto the key bed. In detail, the escape takes place when the toe 2*k* or the bump 2*m* is brought into contact with the associated regulating buttons 5*b*/5*c*, and, accordingly, the gap between the toe/bump 2*k*/2*m* and the first/second regulating buttons 5*b*/5*c* deeply concerns the escape of the jack. The tuner rotates the first regulating button 5*b* around the screw 5*e* so that the first regulating button 5*b* projects from or is retracted into the screw 5*e*. Accordingly, the gap between the toe 2*k* and the first regulating button 5*b* is varied together with the movement of the first regulating button 5*b*. The tuning is carried out without moving the action bracket assembly. The tuner rotates the screw 5*f* around the centerline thereof so as to space the second regulating button 5*c* from or draw the second regulating button 5*c* near the shaft 5*d*. Accordingly, the gap between the bump 2*m* and the second regulating button 5*c* is varied together with the movement of the second regulating button 5*c*. The screw 5*f* is located in the narrow space among the components of the action mechanism 2, and the second regulating button 5*c* is provided under the shaft 5*d*. It Is impossible for the tuner to regulate the gap with the action bracket assembly leaving on the key bed. For this reason, the tuner moves the action bracket assembly from the key bed to a working table, and regulates the gap. However, the tuning work is incomplete. The tuner checks the gap between the hammer assembly 3 and the string 4 by slowly depressing the associated key 1 to see whether or not the hammer assembly 3 is disengaged with the jack 2*d* at an appropriate point. In order to measure the gap between the hammer assembly 3 and the string 4, the tuner moves the action bracket assembly from the working table onto the key bed. The tuner repeats the works until the second regulating button 5*c* is appropriately tuned. Thus, the tuning works are complicated and time-consuming. This is the problem inherent in the prior art tandem regulating button mechanism.

SUMMARY OF THE INVENTION

It is therefore an important object of the present invention to provide a regulating button mechanism, which is easily accurately regulated to optimum escape timing.

It is also an important object of the present invention to provide a silent system, which includes the regulating button mechanism.

It is another important object of the present invention to provide a keyboard musical instrument, which is equipped with the regulating button mechanism.

To accomplish the object, the present invention proposes to.

In accordance with one aspect of the present invention, there is provided a regulating mechanism associated with a jack incorporated in an action mechanism forming a part of a keyboard musical instrument, and the regulating mechanism comprises a regulating member provided for the jack so as to permit the jack to escape from a beating member of the keyboard musical instrument when the jack is brought into contact with the regulating member, a supporting member connected to a stationary member of the keyboard musical instrument, a retainer connected to the regulating member and movably supported by the supporting member and an adjusting mechanism connected between the supporting member and the retainer for changing a relative position between the supporting member and the retainer and having a manipulator projecting into a free space formed in the keyboard musical instrument and manipulated by a tuner for changing a gap between the regulating member and the jack through a relative motion between the retainer and the supporting member.

In accordance with another aspect of the present invention, there is provided a silent system incorporated in a keyboard musical instrument having plural keys, plural action mechanisms respectively connected to the plural keys and arranged in a lateral direction and plural beating members respectively actuated by the plural action mechanisms through first escapes of jacks forming parts of the plural action mechanism for striking plural vibratory members when first portions of the plural jacks are brought into contact with a primary regulating member, and the silent system comprises a stopper provided for the plural beating members and changed between a free position provided out of trajectories of the plural beating members for permitting the plural beating members to strike the plural vibratory members and a blocking position provided on the trajectories for causing the plural beating members to rebound thereon before striking the plural vibratory members, a secondary regulating member changed between an active position provided on trajectories of second portions of the plural jacks and related to the blocking position and an inactive position provided out of the trajectories of the second portions and related to the free position and producing second escapes faster than the first escapes when the second portions are brought into contact therewith, a supporting member provided in the vicinity of the secondary regulating member and connected to a stationary member of the keyboard musical instrument, a retaining member connected to the secondary regulating member and movably supported by the supporting member and an adjusting mechanism connected between the supporting member and the retaining member for changing a relative position between the supporting member and the retaining member and having a manipulator projecting into a free space formed in the keyboard musical instrument and manipulated by a tuner for varying a distance between the second portions and the secondary regulating member through changing the relative position.

In accordance with yet another aspect of the present invention, there is provided a keyboard musical instrument having a fore-and-aft direction and a lateral direction perpendicular to the fore-and-aft direction comprising a keyboard having plural keys selectively moved by a player positioned in front of the keyboard, plural action mechanisms provided over a rear portion of the keyboard so as to create a free space over a front portion of the keyboard, connected to the keys so as to be selectively actuated by the moved keys and having jacks and a primary regulating member for producing first escapes of the jacks when first portions of the jacks are brought into contact with the primary regulating member, plural beating members respectively driven for rotation by the plural action mechanisms when the first escapes or second escapes are produced, plural vibratory members respectively struck with the plural beating members at the end of the rotation, a secondary regulating member opposed to second portions of the jacks and producing the second escape when the second portions are brought into contact therewith, a supporting member connected to a stationary member, a retaining member connected to the secondary regulating member and movably supported by the supporting member so as to change a relative position therebetween, and an adjusting mechanism connected between the secondary regulating member and the supporting member for changing the relative position and having a manipulator projecting into the free space and manipulated for changing a distance between the second portions and the secondary regulating member by changing the relative position.

BRIEF DESCRIPTION OF THE DRAWINGS

The features and advantages of the regulating button mechanism and the keyboard musical instrument will be more clearly understood from the following description taken in conjunction with the accompanying drawings in which.

DESCRIPTION OF THE PREFERRED EMBODIMENTS

First Embodiment

Figure 1:
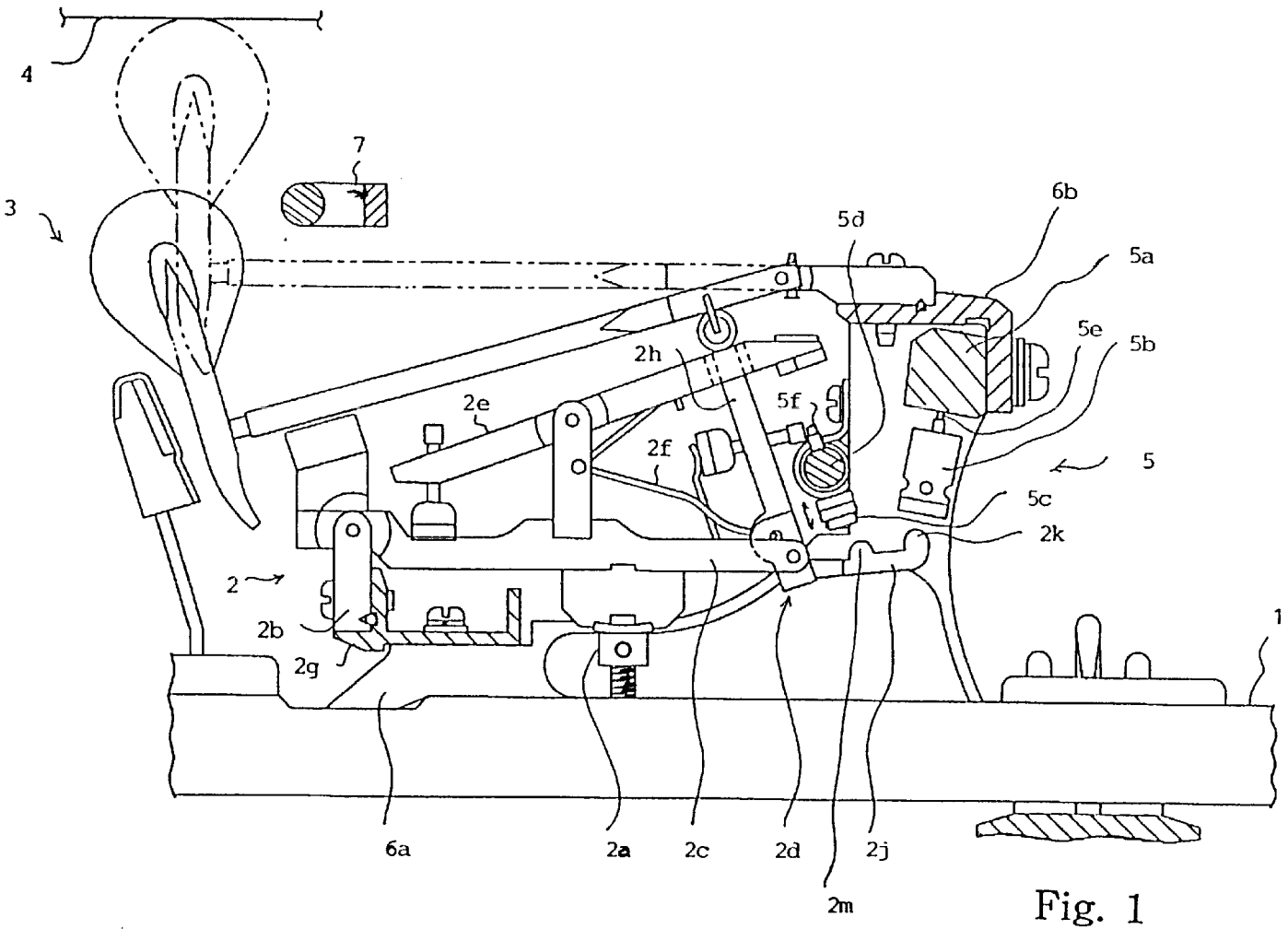
Fig. 1 PRIOR ART
FIG. 1 is a side view showing the tandem regulating button mechanism incorporated in the prior art grand piano.
Figure 2:
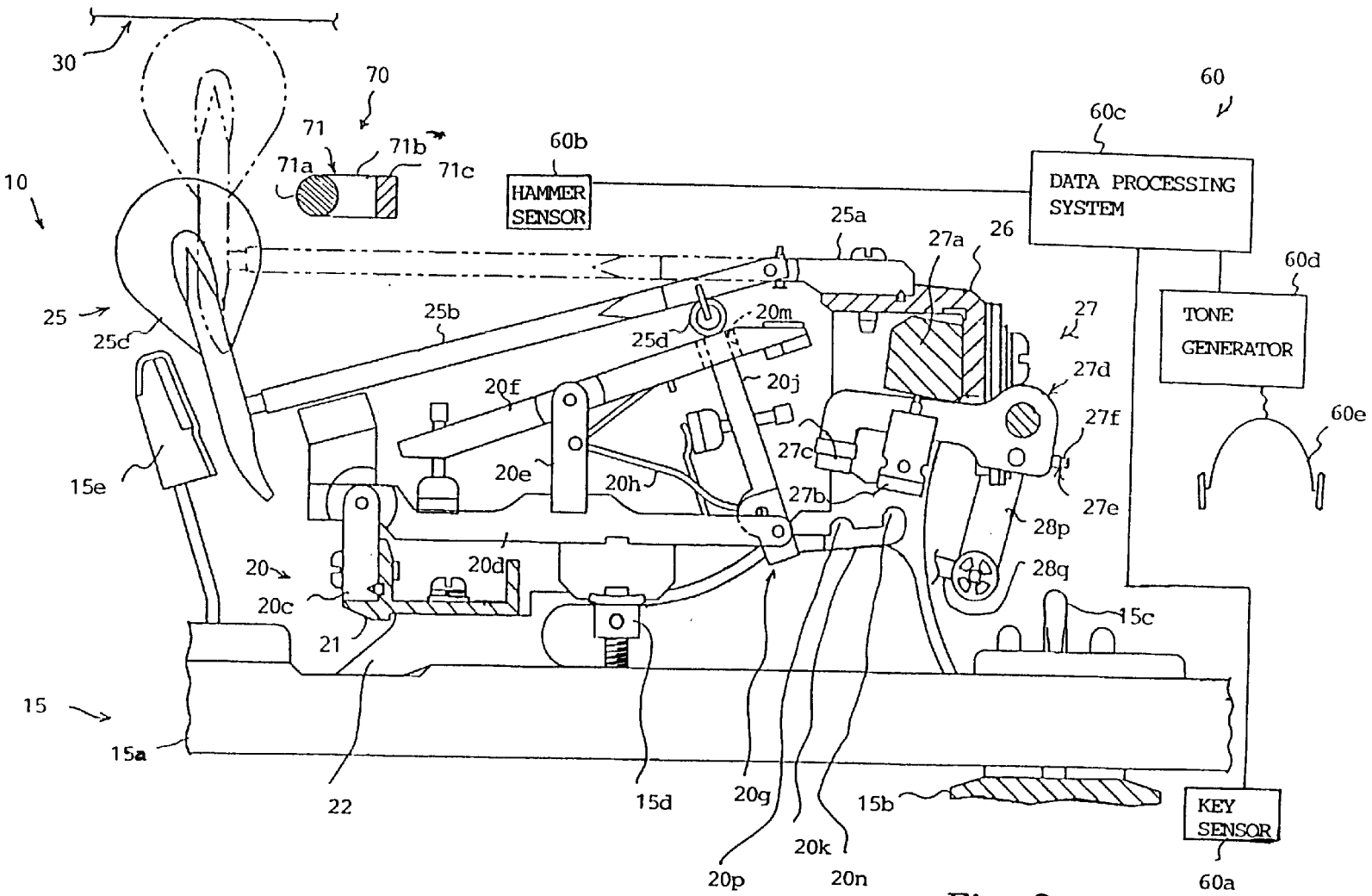
FIG. 2 is a side view showing the arrangement of essential component parts incorporated in a silent piano according to the present invention.

Referring to FIG. 2 of the drawings, a silent piano embodying the present invention largely comprises an acoustic piano 10, an electronic sound generating system 60 and a silent mechanism 70. In the following description, term "front" modifies a position closer to a pianist sitting in front of the acoustic piano 10 than a position modified with term "rear". The "front" is on the right side in FIG. 2, and the "rear" is on the left side in FIG. 2. Term "lateral" is indicative of the direction normal to the paper where FIG. 2 is drawn, and "fore-and-aft" direction is perpendicular to the lateral direction, i.e., the direction from the rear position to the front position.

The acoustic piano 10 is a standard grand piano, and comprises a keyboard 15, a plurality of action mechanisms 20, a plurality of hammer assemblies 25, a tandem regulating button mechanism 27, a plurality of sets of strings 30 and a plurality of dampers (not shown). The action mechanisms 20 are respectively associated with the hammer assemblies 25, which in turn are associated with the sets of strings 30. The keyboard 15 is mounted on a key bed forming a part of a piano housing (not shown), and exposed to the pianist. The action mechanisms 20, the hammer assemblies 25, the sets of strings 30 and the dampers (not shown) are accommodated in the piano housing. While the pianist is fingering on the keyboard 15, the dampers are spaced from and brought into contact with the sets of strings 30 for permitting the strings to vibrate, and the action mechanisms are selectively actuated. The associated hammer assemblies 25 are driven for free rotation by the actuated action mechanisms 20, and strike the associated sets of strings 30 at the end of the free rotation. The sets of strings 30 vibrate so as to generate piano tones. When the dampers are brought into contact with the sets of strings, the vibrations are decayed, and the piano tones are extinguished. Thus, the acoustic piano 10 behaves as the standard grand piano.

The keyboard 15 is constituted by black keys and white keys. The black/white keys are labeled with reference numeral 15*a*, and are arranged in the lateral direction. Each of the black/white keys 15*a* is rotatable with respect to a balance rail 15*b* by means of a balance pin 15*c*. The black/white keys 15*a* are associated with the action mechanisms 20, respectively, and the dampers, respectively. A capstan button 15*d* projects from the rear end portion of the black/white key 15*a*, and is held in contact with the associated action mechanism 20. A back check 15*e* is fixed to the rear end portion of the black/white key 15*a*, and is upright thereon. The back check 15*e* receives the associated hammer assembly 25, which has rebounded on the associated sets of string 30. When a pianist exerts force on the front portion of the black/white keys 15*a*, the front portion is sunk, and, accordingly, the rear portion is lifted. Then, the depressed key 15*a* actuates the associated action mechanism 20 through the capstan button 15*d*, and spaces the associated damper from the set of strings 30. Thus, the force is transmitted through the depressed key 15*a* to the associated damper as well as the associated action mechanism 20.

The action mechanisms 20 are supported by a whippen rail 21, which in turn is supported by action brackets 22. The action brackets 22 are provided on a key frame (not shown), and are spaced from one another in the lateral direction. The action mechanism 20 includes a whippen flange 20*c*, a whippen assembly 20*d*, a repetition lever flange 20*e*, a repetition lever 20*f*, a jack 20*g* and a repetition spring 20*h*. The whippen flange 20*c* is fixed to the whippen rail 20*a*, and is upright thereon. The whippen assembly 20*d* is swingably connected at the rear end portion thereof to the whippen flange 20*c*, and the capstan button 15*d* is held in contact with the lower surface of the whippen assembly 20*d*. The repetition lever flange 20*e* is fixed to the intermediate portion of the whippen assembly 20*d*, and is upright on the whippen assembly 20*d*. The repetition lever 20*f* is rotatably connected by the upper end portion of the repetition lever flange 20*e*.

The jack 20*g* is rotatably connected to the front end portion of the whippen assembly 20*d* at a bent portion by means of a pin, and has a relatively long leg portion 20*j* and a relatively short foot portion 20*k*. A hole 20*m* is formed in the front portion of the repetition lever 20*f*, and the relatively long leg portion 20*j* is inserted into the hole 20*m*. The repetition spring 20*h* is provided between the repetition lever 20*f* and the jack 20*g*, and urges the jack 20*g* in the counter clockwise direction at all times. A toe 20*n* and a bump 20*p* are formed in the relatively short foot portion 20*k*. The bump 20*p* is closer to the bent portion than the toe 20*n*.

A shank flange rail 26 is supported by the action brackets 22, and extends in the lateral direction. The hammer assemblies 25 are swingably supported by the shank flange rail 26, and rearward project therefrom. The hammer assembly 25 includes a hammer shank flange 25*a*, a hammer shank 25*b*, a hammer head 25*c* and a hammer roller 25*d*. The hammer shank flange 25*a* is fixed to the shank flange rail 26 by means of a bolt, and the hammer shank 25*b* is swingably connected to the hammer shank flange 25*a*. The hammer head 25*c* is fixed to the leading end of the hammer shank 25*b*, and is directed to the associated set of strings 30. The hammer roller 25*d* is rotatably connected to the hammer shank 25*b*, and downwardly projects from the lower surface of the hammer shank 25*b*. Although the leading end of the leg portion 20*j* is held in contact with the hammer roller 25*d* until an escape of the jack 20*g*, the hammer assembly 25 starts free rotation upon the escape, and, accordingly, the hammer roller 25*d* is left from the leg portion 20*j*. Upon striking the set of strings 30, the hammer head 25*c* rebounds on the set of strings 30, and the hammer head 25*c* is received by the back check 15*e*. After the depressed key 15*a* is released, the leg portion 20*j* is brought into contact with the hammer roller 25*d*, again.

A regulating rail 27*a* is fixed to the shank flange rail 26 by means of bolts, and extends in the lateral direction. The tandem regulating button mechanism 27 includes a plurality of regulating buttons 27*b*, a plurality of regulating bars 27*c*, a change-over mechanism 27*d* and an adjusting mechanism 27*e*. The regulating buttons 27*b* are respectively associated with the action mechanisms 20 and, accordingly, the black/white keys 15*a*. On the other hand, two regulating bars 27*c* are shared among the jacks 20*g* in one of the higher, middle and lower pitched parts, and, accordingly, six regulating bars 27*c* are incorporated in the tandem regulating button mechanism 27. A pair of regulating screws 27*f* is provided for each of the regulating bars 27*b*, and is used for regulating the gap between each regulating bar 27*c* and the bumps 20*p* of the associated jacks 20*g*. The regulating screws 27*f* frontward project from the change-over mechanism 27*d*, and a tuner is easily accessed through the space in front of the action mechanisms 20.

The regulating buttons 27*b* are hung from the regulating rail 27*a* by means of screws, respectively, and are opposed to the toes 20*n* of the associated jacks 20*g*. The gap between each of the regulating buttons 27*b* and the associated toe 20*n* is changeable by turning the regulating button 27*b* around the screw. A pianist is assumed to depress the black/white key 15*a* The capstan button 15*d* upwardly pushes the whippen assembly 20*d*, and gives rise to rotation of the whippen assembly 20*d* around the whippen flange 20*c* in the counter clockwise direction. The jack 20*g* is rotated together with the whippen assembly 20*d* without any relative rotation with respect to the whippen assembly 20*d*. The leg portion 20*j* pushes the hammer roller 25*d*, and gives rise to rotation of the hammer shank 25*b* and the hammer head 25*c* around the hammer shank flange 25*a*. When the toe 20*n* is brought into contact with the regulating button 27*b*, the reaction from the regulating button 27*b* gives rise to the rotation of the jack 20*g* with respect to the whippen assembly 20*d*. Then, the leg portion 20*j* of the jack 20*g* escapes from the hammer roller 25*d*. The escape gives rise to the free rotation of the hammer assembly 25, and the set of strings 30 is struck with the hammer head 25*c* at the end of the free rotation.

The tandem regulating button mechanism 27 forms parts of the silent system 70 except the regulating buttons 27*b*. For this reason, the regulating bars 27*c*, the change-over mechanism 27*d* and the adjusting mechanism 27*e* are herein later described in detail in conjunction with the silent system 70.

The electronic sound generating system 60 includes a plurality of key sensors 60*a*, a plurality of hammer sensors 60*b*, a data processing system 60*c*, a tone generator 60*d* and a sound system including a headphone 60*e*. The key sensors 60*a* are respectively associated with the black/white keys 15*a*, and produce key positions signals representative of current key positions of the associated black/white keys 15*a*. On the other hand, the hammer sensors 60*b* are respectively associated with the hammer assemblies 25, and produce hammer position signals representative of current hammer positions of the associated hammer assemblies 25. The key sensors 60*a* and the hammer sensors 60*b* are connected in parallel to an interface of the data processing system 60*c*, and a data processor produces music data codes representative of generation of an electronic tone and decay of the electronic tone on the basis of the key motion and the hammer motion. The data processing system 60*c* is connected to the tone generator 60*d*, and the music data codes are supplied to the tone generator 60*d*. The tone generator 60*d* generates an analog audio signal on the basis of the music data codes, and supplies the analog audio signal to the headphone 60*e*, by way of example. The headphone converts the analog audio signal to the electronic tones.

The silent system 70 includes a hammer stopper 71, the change-over mechanism 27*d* and the adjusting mechanism 27*e*. The hammer stopper 71 is provided in the space between the hammer assemblies 25 and the sets of strings 30, and extends in the lateral direction. The hammer stopper 71 is changed between a free position and a blocking position. The change-over mechanism 27*d* is provided in the space under the regulating rail 27*a*, and is connected to the second regulating buttons 27*c*. The change-over mechanism 27*d* is used for concurrently changing the regulating bars 27*c* between a first angular position and a second angular position. The adjusting mechanism 27*e* is attached to the change-over mechanism 27*d*, and independently changes the values of the gap between the second regulating buttons 27*c* and the associated bumps 20*p*.

The hammer stopper 71 includes a shaft 71*a*, brackets 71*b* and shock-absorbing sheets 71*c*. The shaft 71*a* extends in the lateral direction, and are rotatably supported by the piano housing by means of suitable bearing units (not shown). The brackets 71*b* are fixed to the shaft 71*a* at intervals, and the shock-absorbing sheets 71*c* are respectively attached to the brackets 71*b*. The shaft 71*a* is driven for rotation by means of a suitable link work (not shown), and, accordingly, the shock-absorbing sheets 71*c* are rotated together with the shaft 71*a*. While the hammer stopper 71 is staying at the free position, the shock-absorbing sheets 71*c* are out of the trajectories of the hammer shanks 25*b* as shown in FIG. 2, and the sets of strings 30 are struck with the hammer heads 25*c* without any interference of the hammer stopper 71.

Figure 3:
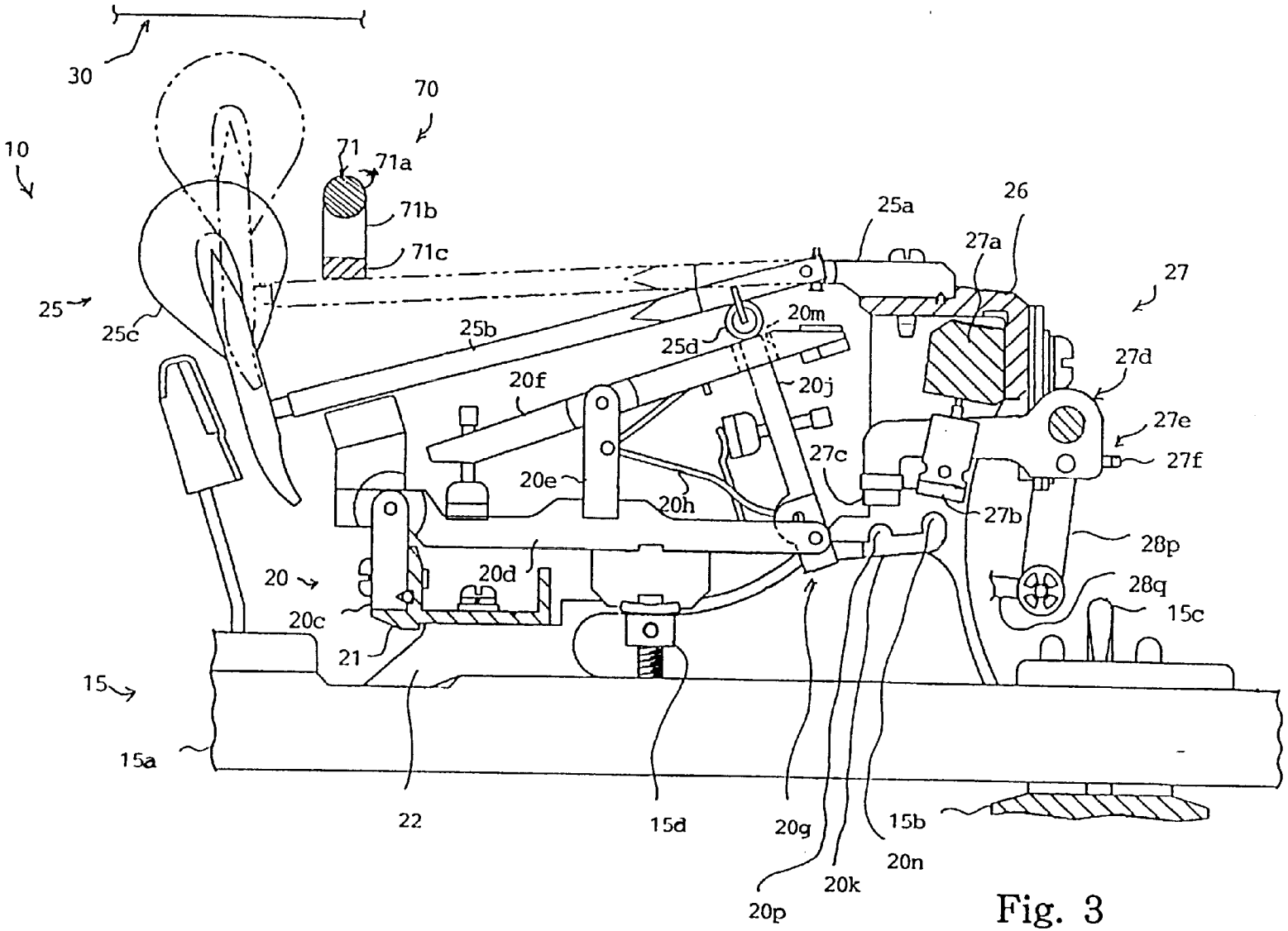
FIG. 3 is a side view showing the arrangement of the essential component parts of the silent piano in an operational condition different from that shown in FIG. 2.

When the hammer stopper 71 is changed to the blocking position, the shock-absorbing sheets 71*c* are moved into the trajectories of the hammer shanks 25*b* so that the hammer shanks 25*b* rebound on the hammer stopper 71 without striking the sets of strings 30 as shown in FIG. 3.

Description is hereinbelow made on the change-over mechanism 27*d* and the adjusting mechanism 27*e* in detail with reference to FIGS. 4, 5, 6 and 7. The change-over mechanism 27*d* is attached to the front surface of the shank flange rail 26, and includes a shaft 28*a*, bearing units 28*b*/28*c*, retainers 28*d*/28*e* and a link work 28*f*. The link work 28*f* and the link work of the hammer stopper 71 may be connected to a grip, a foot pedal or an output shaft of an electric motor so as to concurrently change the hammer stopper 71 and the change-over mechanism 27*d* between the free/first angular positions and the blocking/second angular positions.

The shaft 28*a* extend in the lateral direction, and are rotatably supported by the shank flange rail 26 by means of the bearing units 28*b*/28*c*. Each of the bearing units 28*b*/28*c* has a short plate member 28*g*, a long plate member 28*h* and a cover plate member 28*j*. The length of the short plate member 28*g* is approximately equal to the width of the front surface of the shank flange rail 26, and a through-hole is formed in the short plate member 28*g*. The long plate member 28*h* is approximately equal in length to the cover plate member 28*j*, and the cover plate member 28*j* has a generally Ω-letter shape . Two through-holes are formed in the long plate member 28*h*, and two through-holes are also formed in both side portions of the cover plate member 28*j*. The through-holes in the long plate member 28*h* are spaced equally to the through-holes formed in the cover plate member 28*j*, and, accordingly, are aligned therewith. A pair of female bolt holes 28*k* is formed in the shank flange rail 26, and are open to both side areas of the front surface thereof. The short plate member 28*g*, the long plate member 28*h* and the cover plate member 28*j* are laminated on the front surface of the shank flange rail 26, and the shaft 28*a* is sandwiched between the long plate member 28*h* and the cover plate member 28*j*. The through-hole in the short plate member 28*g*, the upper through-hole in the long plate member 28*h* and the upper through-hole of the cover plate member 28*j* are aligned with the female bolt hole 28*k*, and a long bolt 28*m* is screwed into the female bolt hole 28*k*. A short bolt 28*n* is further screwed into the through-hole in the long plate member 28*h* and the through-hole in the cover plate member 28*j*. The bearing units 28*b*/28*c* are assembled, and the shaft 28*a* is rotatably supported by means of the bearing units 28*b* and 28*c*.

Figure 4:
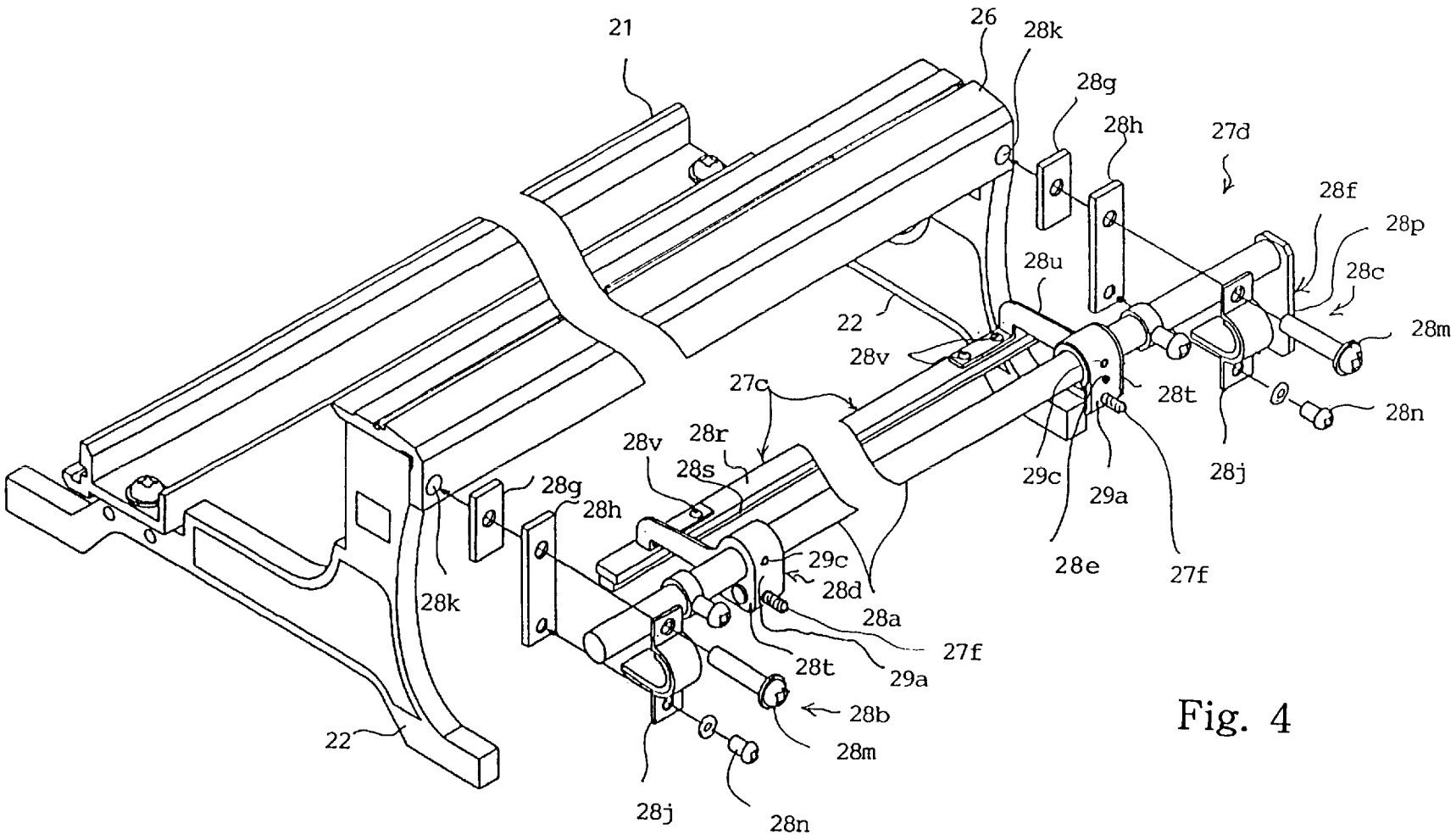
FIG. 4 is a fragmentary perspective view showing a change-over mechanism and an adjusting mechanism incorporated in a tandem regulating button mechanism of the silent piano.

The link work 28*f* includes a regulating lever 28*p* and a link member 28*q* (see FIG. 4). The regulating lever 28*p* is fixed at the upper end thereof to the shaft 28*a*, and the link member 28*q* is rotatably connected to the lower end of the regulating lever 28*p*. The link member 28*q* in turn is connected through other link members to the grip or the foot pedal. Otherwise, the link member 28*q* is connected to the output shaft of the electric motor through a suitable rotation-to-reciprocal motion converter (not shown).

Each of the regulating bars 27*c* is broken down into a bracket 28*r* and a regulating cloth 28*s*. The retainers 28*d*/28*e* are supported by the shaft 28*a*, and rearward project from the shaft 28*a*. The rear end portion of the retainers 28*d*/28*e* are fixed to both end portions of the bracket 28*r*, and the regulating cloth 28*s* is attached to the lower surface of the bracket 28*r*. Although the bump 20*p* is brought into contact with the regulating bar 27*c*, the regulating cloth 28*s* extinguishes the noise at being brought into contact.

Each of the retainers 28*d*/28*e* has an arm plate 28*t*, a ring member 28*u*, bolts 28*v* and a bushing cloth 28*w*. A circular hole is formed in the arm plate 28*t*, and the ring member 28*u* is fixed to the arm plate 28*t* in such a manner as to align the circular hole with a through-hole of the ring member 28*u*. The bushing cloth 28*w* is bonded to the inner surface of the ring member 28*u*. The shaft 28*a* is inserted into the circular hole and the through-hole, and the bushing cloth 28*w* permits the retainers 28*d*/28*e* to be smoothly rotated around the shaft 28*a*. The arm plate 28*t* rearward projects from the shaft 28*a*, and is fixed to the bracket 28*r* by means of bolts 28*v*. Thus, the regulating bar 27*c* is supported by the shaft 28*a* by means of the retainers 28*d* and 28*e*.

Figure 5:
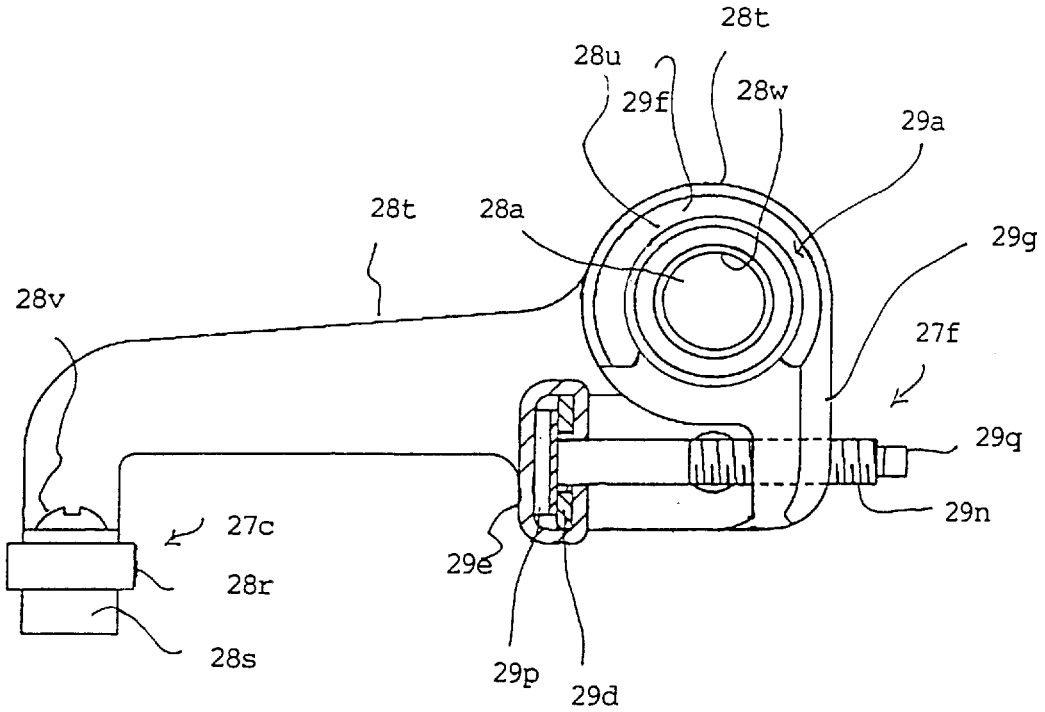
FIG. 5 is a cross sectional side view showing the change-over mechanism.
Figure 6:
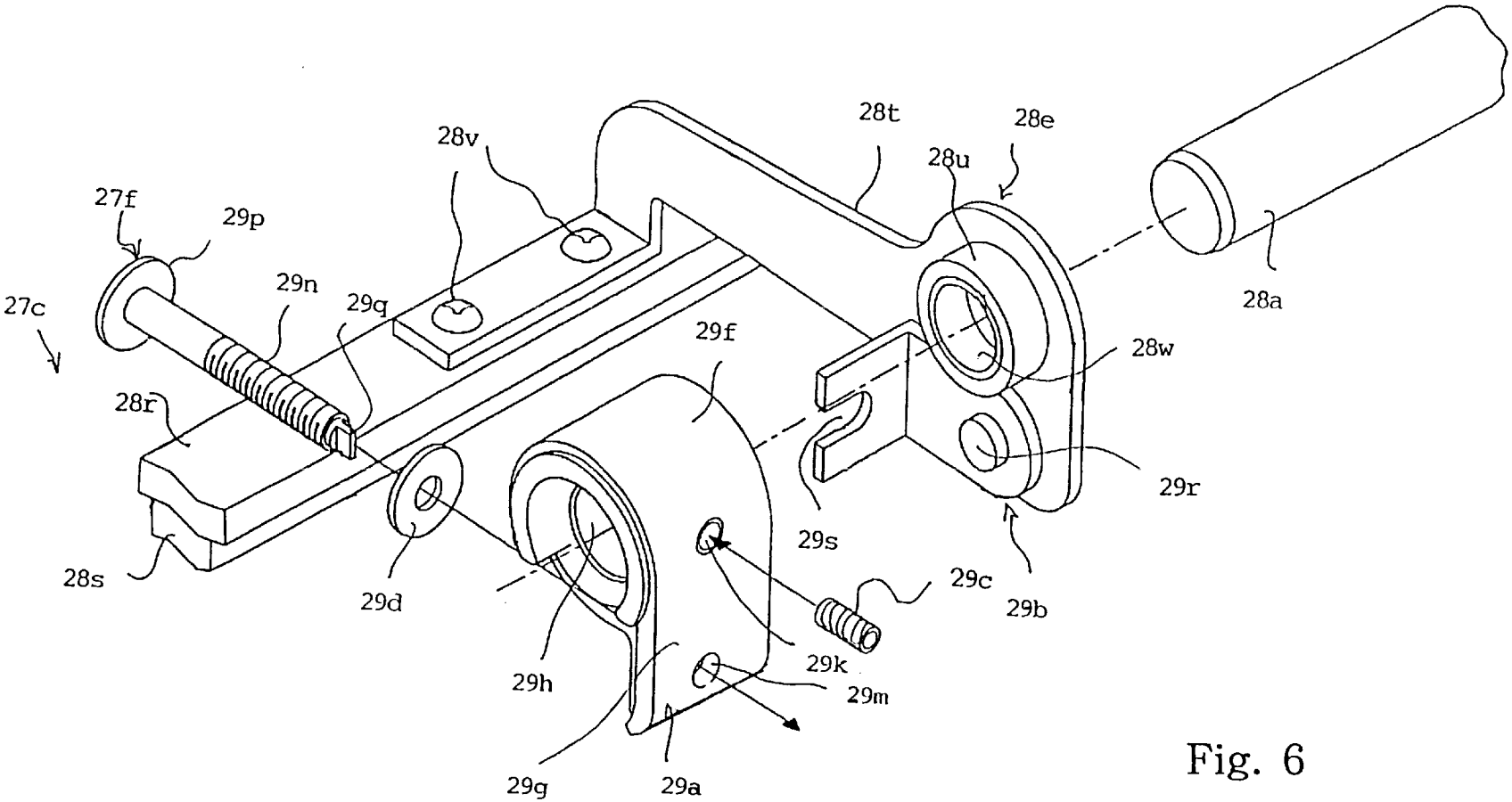
FIG. 6 is a fragmentary perspective view showing the adjusting mechanism.
Figure 7:
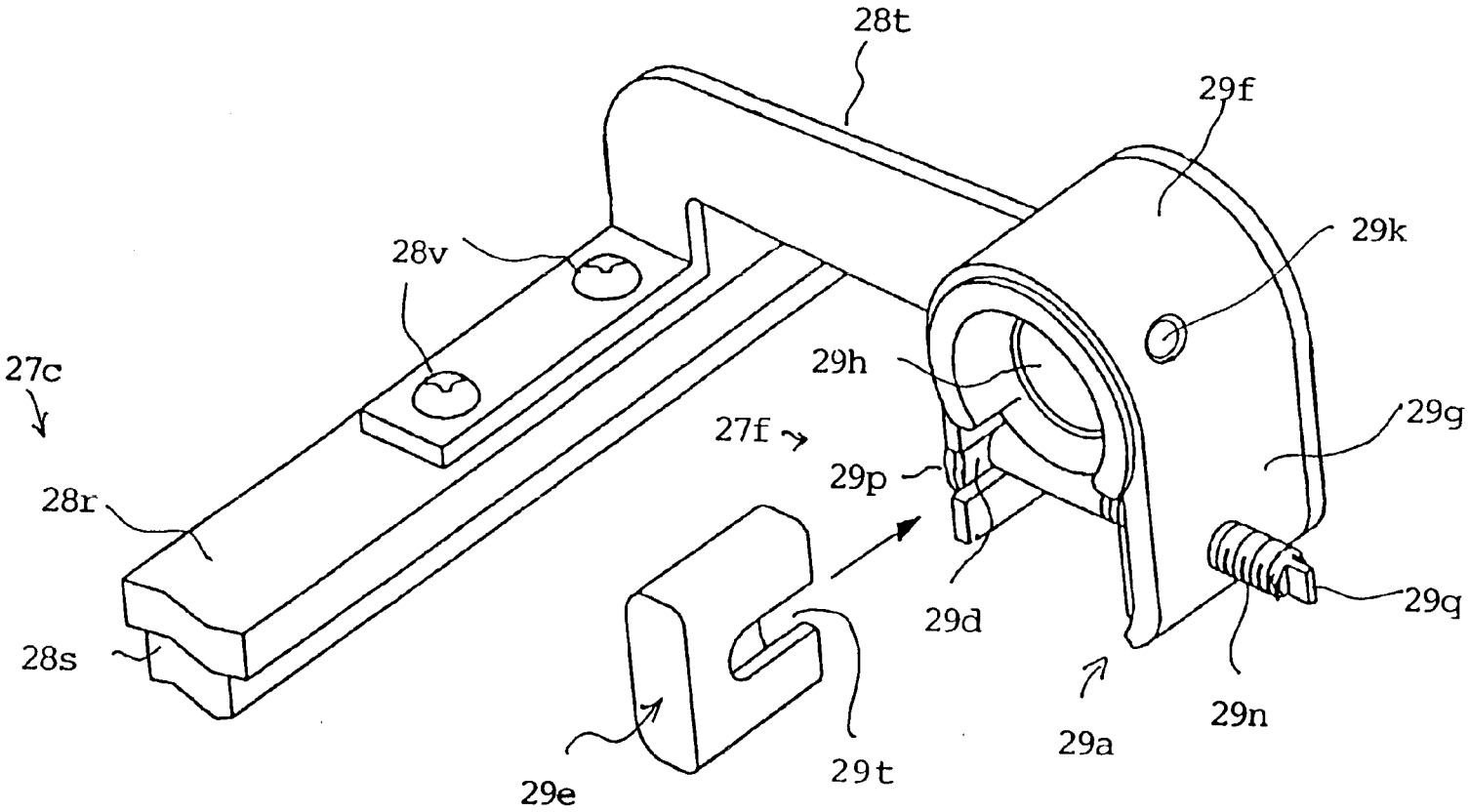
FIG. 7 is a fragmentary perspective view showing the adjusting mechanism.

The adjusting mechanism 27*e* is shown in FIGS. 5, 6 and 7 in detail. The adjusting mechanism 27*e* includes stationary brackets 29*a*, rotatable angle members 29*b*, the regulating screws 27*f*, bracket set screws 29*c*, punching cloth members 29*d* and caps 29*e*. A pair of adjusting units is associated with each of the regulating bar 27*c*. The stationary bracket 29*a*, the rotatable angle member 29*b*, the regulating screw 27*f*, the bracket set screw 29*c*, the punching cloth member 29*d* and the cap 29*e* are assembled into on e of the adjusting units provided at one end portion of the regulating bar 27*c*, and another stationary bracket 29*a*, another rotatable angle member 29*b*, another regulating screw 27*f*, another bracket set screw 29*c*, another punching cloth member 29*d* and another cap 29*e* are assembled into another adjusting unit provided at the end portion of the regulating bar 27*c*. The pair of adjusting units is provided at both end portions of each of the regulating bars 27*c*. The adjusting units are identical in structure to one another, and only the adjusting unit provided on the right side is hereinbelow detailed.

The pair of adjusting units give rise to relative rotation between the retainers 28*d*/28*e* and the shaft 28*a* for changing the gap between the bumps 20*p* and the associated regulating bar 27*c*. As described hereinbefore, the retainer 28*e* is broken down into the arm plate 28*t*, the ring member 28*u* and the bolts 28*v*. The stationary bracket 29*a* has a shape like numeral letter "9", and is broken down into a ring portion 29*f* and a plate portion 29*g*. A through-hole 29*h* is defined in the ring portion 29*f*, and has the inner diameter slightly larger than the outer diameter of the ring member 28*u*. For this reason, when the stationary bracket 29*a* is assembled with the retainer 28*e*, the ring portion 28*u* is rotatably received in the through-hole 29*h* of the ring portion 29*f*. The ring portion 29*f* is wider than the ring member 28*u*, and the left side surface of the ring member 28*u* is retracted into the through-hole 29*h*. The through-hole 29*h* is coincident with the through-hole of the ring member 28*u*, and the shaft 28*a* passes the through-hole of the ring member 28*u*. A bolt hole 29*k* is formed in the ring portion 29*f*, and the bracket set screw 29*c* is screwed into the bolt hole 29*k*. The bracket set screw 29*c* is pressed against the shaft 28*a*, and the stationary bracket 29*a* is secured to the shaft 28*a*. Thus, the stationary bracket 29*a* and the shaft 28*a* do not change the relative position there-between after assembling together.

A bolt hole 29*m* is formed in the plate portion 29*g*, and the regulating screw 27*f* frontward projects from the plate portion 29*g*. The regulating screw 27*f* has a threaded stem portion 29*n*, a head portion 29*p* and a thin edge portion 29*q*. The threaded stem portion 29*n* is screwed into the bolt hole 29*m*. The threaded stem portion 29*n* passes the hole formed in the punching cloth member 29*d*, and the thin edge portion 29*q* projects from the plate portion 29*g*.

The angle member 29*b* is rotatably connected to the arm plate 28*t* by means of a pin 29*r*, and the pin 29*r* has a centerline offset from the centerline of the through-hole formed in the ring member 28*u*. A slot 29*s* is formed in the rotatable angle member 29*b*, and is open to the left side surface of the rotatable angle member 29*b*. The slot 29*s* has a width slightly larger than the diameter of the threaded stem portion 29*n* but smaller than the diameter of the head portion 29*p*. When the stationary bracket 29*a* is appropriately secured to the shaft 28*a*, the rotatable angle member 29*b* is opposed to the plate portion 29*g*, and the slot 29*s* is aligned with the bolt hole 29*m*. For this reason, the regulating screw 27*f* passes the slot 29*k*, and is screwed into the bolt hole 29*m*. Thus, the regulating screw 27*f* is supported at the front end thereof by the stationary bracket 29*a* and at the boss portion thereof by the rotatable angle member 29*b*.

The thin edge portion 29*q* projects into the relatively wide space in front of the array of the action mechanisms 20, and a tuner is able to easily turn the regulating screw 27*f* with a suitable tool engaged with the thin edge portion 29*q*.

An inner space is defined in the cap 29*e*, and is exposed to the outside through a slot 29*t*. The inner space is approximately equal to the total thickness of the head portion 29*p*, the bushing cloth 29*d* and the rotatable angle member 29*b*. When the cap 29*e* is pushes toward the head portion 29*p* which have been already supported by the rotatable angle member 29*b* and the plate portion 29*g*, the cap 29*e* slides on the stem portion, and the head portion 29*p*, the bushing cloth 29*d* and the rotatable angle member 29*b* are received in the inner space of the cap 29*e*. Thus, the head portion 29*p* and the rotatable angle member 29*b* are bound together by means of the cap 29*e*.

Assuming now that a tuner turns the regulating screws 27*f* so as to widen the gap between the rotatable angle members 29*b* and the plate portions 29*g* of the stationary brackets 29*a*, the head portions 29*p* is rearward moved, and push the rotatable angle members 29*b* through the caps 29*e*, because the bracket set screws 29*c* prohibit the stationary brackets 29*a* from rotation around the centerline of the shaft 28*a*. The force gives rise to not only the rotation of the rotatable angle members 29*b* around the pins 29*r* but also the rotation of the arm members 28*t* around the shaft 28*a*. The retainers 28*d*/28*e* are rotated in the clockwise direction in FIG. 5 together with the regulating bar 27*c*. This results in increase of the gap between the regulating bar 27*c* and the bumps 20*p* of the associated jacks 20*g*.

On the other hand, when the tuner decreases the gap between the bumps 20*p* and the regulating bar 27*c*, the tuner turns the regulating screws 27*c* in the opposite direction, and decreases the gap between the rotatable angle members 29*b* and the plate portions 29*g*. The stationary bracket members 29*a* do not change the position with respect to the shaft 28*a*, and the regulating screws 27*f* are further screwed into the bolt holes 29*m*. The head portions 20*p* push the rotatable angle members 29*b* toward the plate portion 29*g* by means of the caps 29*e*, and the arm members 28*t* are driven for rotation in the counter clockwise direction. Thus, the tuner decreases the gap between the regulating bar 27*c* and the bumps 20*p* by means of the adjusting units.

When a pianist wishes to play a tune through the piano tones, he or she manipulates the grip or the foot pedal (not shown) or instructs the electric motor (not shown) to rotate the output shaft in order to change the hammer stopper 71 and the regulating bars 27*c* to the free position and the first angular position, respectively. The shaft 71*a* is driven for rotation, and the shock-absorbing sheets 71*c* are moved out of the trajectories of the hammer shanks 25*b*. On the other hand, the link member 28*q* is rearward pulled, and the regulating lever 28*p* is rotated in the clockwise direction in FIGS. 2 and 3. The rotation is transmitted through the shaft 28*a* and the retainers 28*d*/28*e* to the regulating bars 27*c*, and the regulating bars 27*c* are moved out of the trajectories of the bumps 20*p*. Thus, the silent piano is changed to an acoustic sound mode, and the pianist gets ready for the performance.

The pianist selectively depresses the black/white keys 15*a* for the perfomance. While the pianist is playing the tune on the keyboard 15, the pianist is assumed to depress one of the black/white key 15*a* shown in FIG. 2 . The front portion of the black/white key 15*a* is sunk, and, accordingly, the rear end portion is lifted. The capstan button 15*d* pushes the whippen assembly 20*d*, and gives rise to the rotation of the whippen assembly 20*d* in the counter clockwise direction around the whippen flange 20*c*. The jack 20*g* is rotated around the whippen flange 20*c* without any rotation around the whippen assembly 20*d*, and pushes the hammer roller 25*d*. The toe 20*n* is getting closer and closer to the regulating button 27*b*. When the toe is brought into contact with the regulating button 27*b*, the reaction gives rise to the rotation of the jack 20*g* a round the front end portion of the whippen assembly 20*d* in the clockwise direction. The jack 20*g* escapes from the hammer roller 25*d* at a relatively low speed, and the escape gives rise to the free rotation of the hammer assembly 25 in the clockwise direction. The hammer head 25*c* reaches the associated set of strings 30 without any interference of the hammer stopper 71, and strikes the set of strings 30. The strings 30 vibrate for generating the piano tone.

The hammer head 25*c* rebounds on the set of strings 30, and the back check 15*e* receives the hammer assembly 25. When the pianist releases the depressed key 15*a*, the whippen assembly 20*d* is rotated in the clockwise direction, and the to e 20*n* is spaced from the regulating button 27*b*. The hammer assembly 25 is released from the back check 15*e*, and the leg portion 20*j* slides into the hammer roller 25*d*.

When the pianist wishes to practice the fingering on the keyboard 15, he or she manipulates the grip or the foot pedal or instructs the electric motor to rotate the output shaft in the opposite direction. The shaft 71*a* is driven for rotation in the clockwise direction, and the shock absorbing sheets 71*c* enter into the trajectories of the hammer shanks 25*b*. On the other hand, the link member 28*q* is frontward pushed, and the regulating lever 28*p* is driven for rotation in the counter clockwise direction. The regulating bars 27*c* enter into the trajectories of the bumps 20*p*, and are opposed thereto. Thus, the silent piano is changed to the silent mode of operation.

While the pianist is fingering on the keyboard 15, he or she is assumed to depress the black/white key 15*a* shown in FIG. 3. The depressed key 15*a* renders the capstan button 15*d* pushing the whippen assembly 20*d* upwardly. The whippen assembly 20*d* is rotated around the whippen flange 20*c*. The toe 20*n* and the bump 20*p* get closer and closer to the regulating button 27*b* and the regulating bar 27*c*, respectively. The toe 20*n* and the bump 20*p* are concurrently brought into contact with the regulating button 27*b* and the regulating bar 27*c*, and the reaction from the regulating bar 27*c* gives rise to the rotation of the jack 20*g* around the front end portion of the whippen assembly 20*d*. The jack 20*g* escapes from the hammer assembly 25 at a relatively high speed, because the angular velocity at the bump 20*p* is larger than the angular velocity at the toe 20*n*. The hammer assembly 25 starts the free rotation. However, the hammer assembly 25 rebounds on the hammer stopper 71 before striking the set of strings 30. Thus, although the jack 20*g* escapes from the hammer assembly 25 in the silent mode at the same timing as in the acoustic sound mode, the jack 20*g* completes the escape in the silent mode earlier than that in the acoustic sound mode. While the jack 20*g* is escaping from the hammer roller 25*d*, the whippen assembly 20*d* is further rotated, and, accordingly, the leg portion 20*j* is moved upwardly. The leg portion 20*j* is slightly moved in the silent mode. The movement of the leg portion 20*j* in the silent mode is less than the movement of the leg portion 20*j* in the acoustic mode, because the jack 20*g* completes the escape earlier than that in the acoustic sound mode. This results in that the jack 25 is less liable to be pinched between the hammer stopper 71 and the jack 20*g* without the change of the piano key touch.

When the pianist depresses the black/white key 15*a*, the key sensor 60*a* and the hammer sensor 60*b* start the monitoring, and supply the key position signal and the hammer position signal to the data processing system 60*c*. The data processing system 60*c* specifies the depressed key 15*a* on the basis of the key/hammer position signal, and calculates the hammer velocity immediately before the hammer assembly 25 rebounds on the hammer stopper 71. When the hammer assembly 25 passes a predetermined point immediately before the rebound, the data processing system 60*c* supplies the music data codes representative of the key code assigned to the depressed key 15*a*, the note-on event and the hammer velocity to the tone generator 60*d*. The tone generator 60*d* produces the audio signal, and supplies it to the headphone 60*e*. The headphone 60*e* converts the audio signal to the electronic tone, and the pianist confirms the fingering through the electronic tone.

When the pianist releases the depressed key 15*a*, the black/white key 15*a* starts toward the rest position. The released key 15*a* passes a predetermined position on the way toward the rest position. Then, the data processing system 60*c* supplies the music data codes representative of the key code and the note-of event to the tone generator 60*d*. Then, the electronic tone is decayed.

Figure 8A:
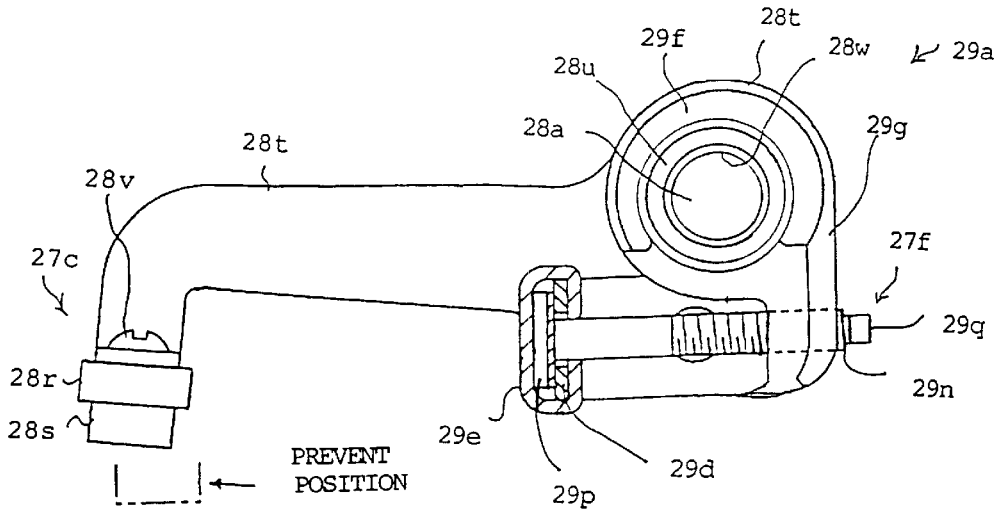
FIGS. 8A and 8B are side views showing the change-over mechanisms changed between the first angular position and the second angular position.

The silent piano is assumed to have been used for a long time. The regulating bars 27*c* are unintentionally moved from the appropriate position to the position indicated by dots-and-dash lines in FIG. 8A, and the escape in the silent mode becomes earlier than the escape in the acoustic sound mode. A tuning is required. In this situation, the regulating bars 27*c* are to be upwardly moved from the present position. A tuner accesses the space in front of the array of action mechanisms 20 without moving it from on the key bed, and turns the thin edge portions 29*q* in such a manner that the head portions 29*p* rearwardly project. This results in that the distances between the head portions 29*p* and the plate portions 29*g* are increased. Although the stationary brackets 29*a* are secured to the shaft 28*a*, the angle members 29*b* are rotatably connected to the arm members 28*t*, and the retainers 28*d*/28*e* are rotatable around the shaft 28*a*. The head portions 29*p* exert the force on the associated angle members 29*b* through the caps 29*e*. The pins 29*r* permit the angle members 29*b* to keep the angular positions thereof in parallel to the regulating screws 27*f*, and the tangential force components give rise to the rotation of the arm members 28*t* in the clockwise direction. Accordingly, the regulating bar 27*c* is rotated in the clockwise direction together with the retainers 28*d*/28*e*, and reaches the appropriate position indicated by real lines in FIG. 8A.

Figure 8B:
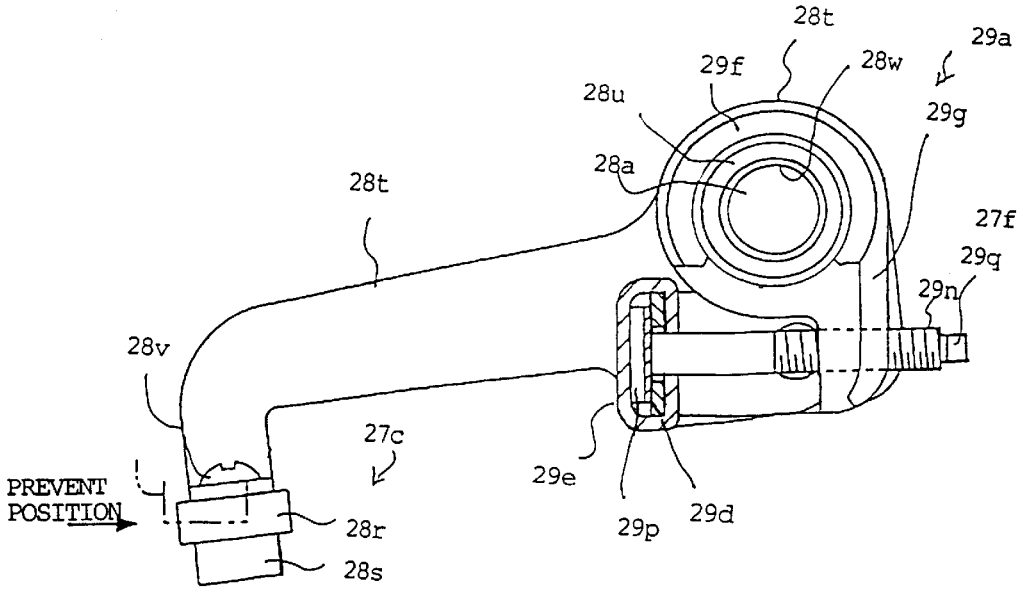

On the other hand, if the regulating bars 27*c* are spaced from the appropriate position as indicated by dots-and-dash lines in FIG. 8B. The completion of the escape in the silent mode becomes later. In the worst case, the hammer shank 25*b* is pinched between the jack 20*g* and the hammer stopper 71 . The regulating bars 27*c* are to be moved downwardly.

The tuner accesses the thin edge portions 27*f* from the space in front of the array of the action mechanisms 20, and turns the regulating screws 27*f* in such a manner that the thin edge portions 29*q* further project from the plate portions 29*g*. The bracket set screws 29*c* keep the brackets 29*a* stationary with respect to the shaft 28*a*. The distance between the head portions 29*p* and the plate portions 29*g* is reduced, and forces are exerted on the angle members 29*b* through the caps 29*e*. The pins 29*r* permits the angle members 29*b* to keep the attitude in parallel to the regulating screws 27*f*, and the tangential force components give rise to the rotation of the retainers 28*d*/28*e* in the counter clockwise direction. Accordingly, the regulating bars 27*c* are rotated in the counter clockwise direction together with the retainers 28*d*/28*e*, and reach the appropriate positions.

The distance between the bumps 20*p* and the regulating bars 27*c* are varied depending upon the angle of rotation on the regulating screws 27*f*. The tuner may repeat the tuning work shown in FIGS. 8A and 8B before adjusting the regulating bars 27*c* to the appropriate positions. However, the tuner does not need moving the array of action mechanisms 20 from on the key bed. As a result, the tuning work becomes easier than the tuning work on the prior art tandem regulating button mechanism.

As will be appreciated from the foregoing description, the adjusting mechanism 27*e* according to the present invention permits a tuner to adjust the regulating bars 27*c* to the position where the jack 20*g* is concurrently brought into contact with the regulating button 27*b* and the regulating bar 27*c* without moving the array of action mechanisms 20 from on the key bed. This results in reduction of the time consumed in the turning work.

Moreover, the tuner can check the distance between the hammer heads 25*c* and the sets of strings 30 to see whether or not the regulating buttons 27*b* and the regulating bars 27*c* are adjusted to the appropriate positions immediately after the adjustment. If the tuner needs further tuning work, he or she immediately restarts it without changing the current state, and accurately adjusts the regulating bars 27*c* to the appropriate positions.

Although the regulating screws 27*f* is straightly moved, the rotatable angle members 29*b* extracts the tangential force component to be exerted on the retainers 28*d*/28*e* from the force exerted thereon through the rotation around the pins 29*r*. The linear motion-to-rotation converting mechanism, i.e., the combination of the angle member 29*b*. The pin 29*r* and the cap 29*e* are quite simple, and are less troubled. The linear motion-to-rotation converting mechanism prevents the regulating screw 27*f* from undesirable bending moment, and keeps the face-to-face contact between the head portion 29*p* and the angle member 29*b*. This results in that the force is surely transmitted from the regulating screw 27*f* to the angle member 29*b* and that the regulating screw 27*f* is durable.

Second Embodiment

Figure 9:
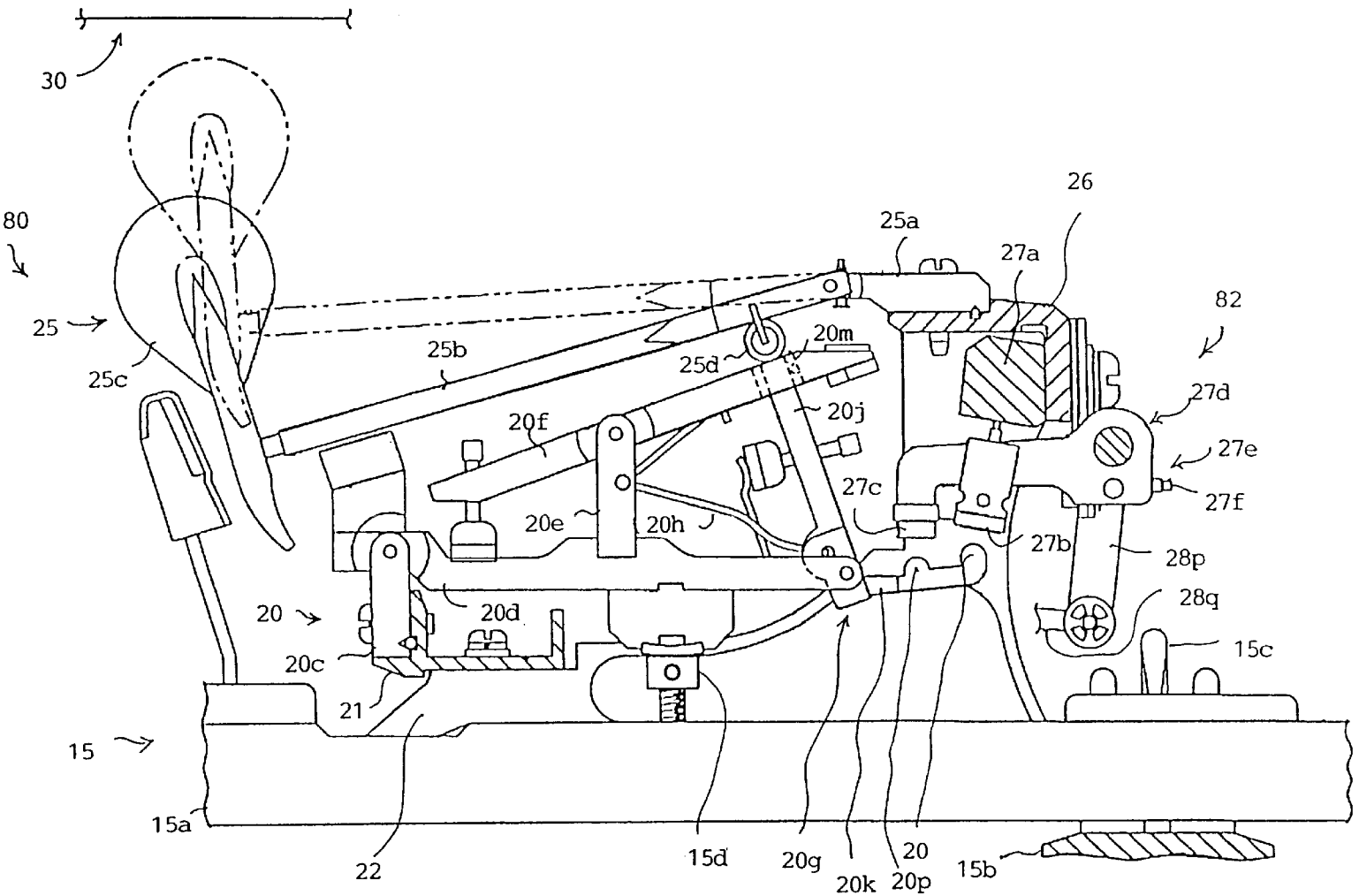
FIG. 9 is a schematic side view showing the structure of a mute piano according to the present invention.

Turning to FIG. 9 of the drawings, a mute piano embodying the present invention largely comprises a grand piano 80 and a tandem regulating button mechanism 82. The grand piano 80 is similar in structure to the grand piano 10, and, for this reason, component parts of the grand piano 80 are labeled with the references designating the corresponding component parts of the grand piano 10 without detailed description for the sake of simplicity.

The regulating bars 27*c* are changed between the first angular position and the second angular position by means of the change-over mechanism 27*d*, and are regulable to the appropriate angular position through the adjusting mechanism 27*e* as similar to that of the first embodiment. The tuning work is similar to that described hereinbefore, and is not repeated.

The mute piano is changed between an acoustic sound mode and a muting mode. When a pianist wishes to play a tune in the acoustic sound mode, the regulating bars 27*c* are changed to the first angular position. The pianist plays the tune on the keyboard 15, and the regulating buttons 27*b* render the jacks 20*g* escaping from the hammer rollers 25*d* at the relatively low speed. A relatively long time is consumed in the escape, and a large force is transmitted to the hammer roller 25*d* through the escape. For this reason, the hammer assembly 25 is driven for rotation at a high speed, and strikes the set of strings 30 as usual.

On the other hand, when the pianist wishes to practice the fingering at small loudness, the pianist changes the regulating bars 27*c* to the second angular position, and the mute piano is established in the muting mode. The toe 27*b* and the bump 20*p* are to be concurrently brought into contact with the regulating button 27*b* and the regulating bar 27*c* in the muting mode. While the pianist is practicing the fingering on the keyboard 15, the black/white key 15*a* is depressed, and the depressed key 15*a* gives rise to the rotation of the whippen assembly 20*d*. When the toe 27*b* and the bump 20*p* are concurrently brought into contact with the regulating button 27*b* and the regulating bar 27*c*, the reaction from the regulating bar 27*c* gives rise to the rotation of the jack 20*g* around the front end portion of the whippen 20*d* at a large angular velocity, and the jack 20*g* completes the escape within a short time. This means that only a small amount of force is transmitted to the hammer roller 25*d*, and the hammer assembly 25 is slowly rotated. This results in a weak impact at the set of strings 30, and the loudness of the piano tone is reduced.

Thus, the tandem regulating button mechanism 82 permits the pianist to practice the fingering without disturbance to the neighborhood.

The tandem regulating button mechanism 82 achieves all the advantages. Moreover, the hammer stopper 71 and the electronic sound generating system are not required for the mute piano. This results in that the manufacturer can offer the mute piano at a price lower than that of the silent piano.

Third Embodiment

Figure 10:
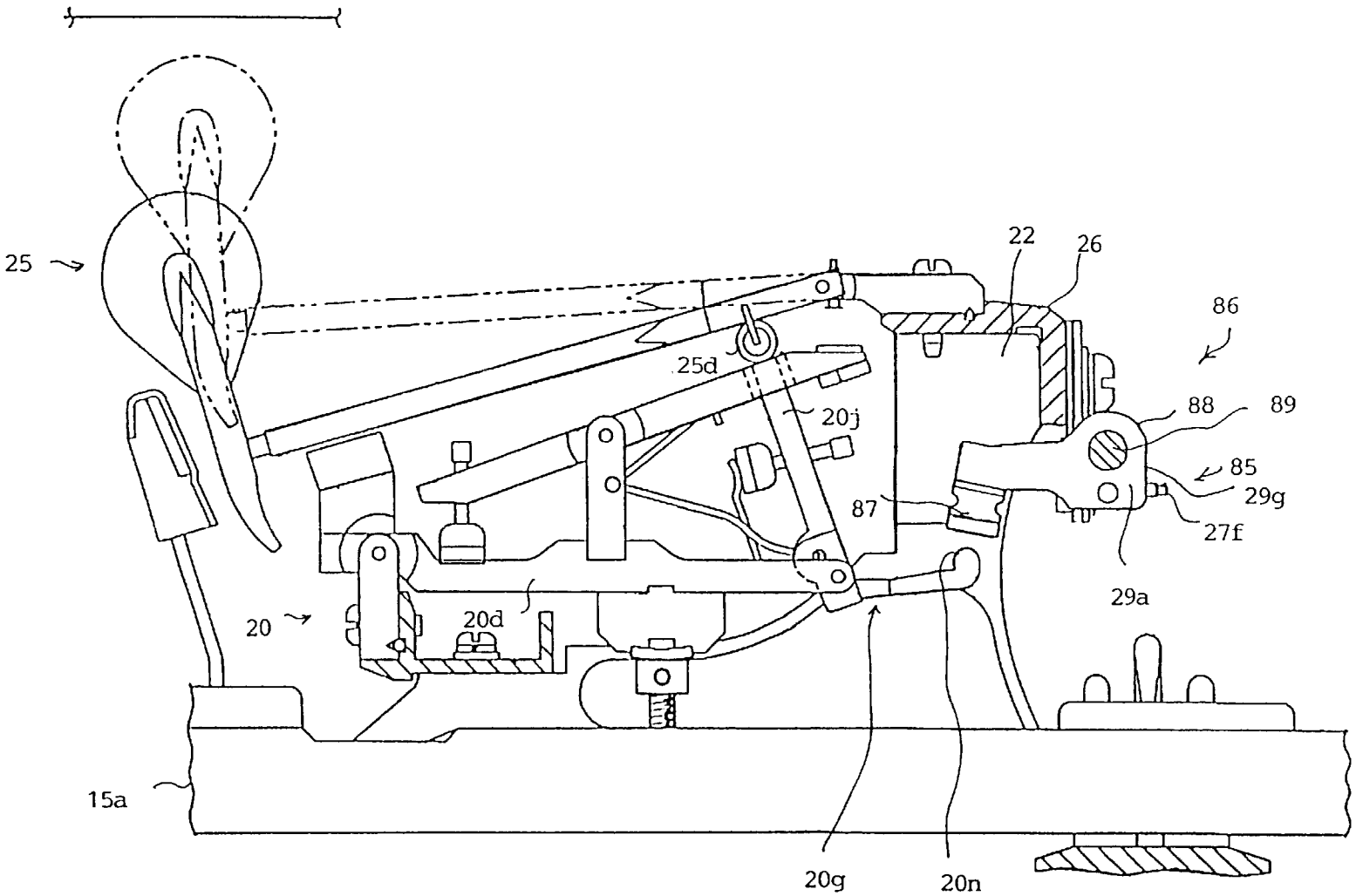
FIG. 10 is a schematic side view showing the structure of a standard grand piano according to the present invention.

Turning to FIG. 10 of the drawings, an adjusting mechanism 85 according to the present invention is directly applied to regulating buttons incorporated in a standard grand piano. The standard grand piano is similar in structure to the grand piano 10 except for a regulating button system 86. For this reason, description is focused on the regulating button system 86. The other component parts of the standard grand piano are labeled with the references designating corresponding parts of the first embodiment without detailed description for the sake of simplicity.

The regulating button system 86 includes regulating buttons 87, retainers 88, a shaft 89 and the adjusting mechanism 85. The regulating buttons 87 are opposed to the toes 20*n* of the jacks 20*g*, respectively, and are supported by the retainers 88. The retainers 88 are rotatably supported by the shaft 89, and the adjusting mechanism 85 is provided between the retainers 88 and the shaft 89. The shaft 89 is fixed to the shank flange rail 26. The retainers 88 are similar in structure to the retainers 28*d*/28*e*, and the adjusting mechanism 85 is similar in structure to the adjusting mechanism 27*e*. Accordingly, the regulating screws 27*f* frontwardly project from the plate portions 29*g* of the brackets 29*a*. Though not shown in FIG. 10, the rotatable angle members 29*b* and the caps 29*e* are further incorporated in the adjusting mechanism 85.

When a tuner turns the regulating screws 27*f* in such a manner as to be retracted into the brackets 29*a*, the distance between the plate portions 20*g* and the angle members 29*b* is increased, and the retainers 88 and, accordingly, the regulating buttons 87 are rotated in the clockwise direction. This results in that the regulating buttons 87 are spaced from the toes 20*n*. On the other hand, when the tuner turns the regulating screws 27*f* in such a manner as to project from the plate portions 29*g*, the distance between the angle members 29*b* and the plate portions 29*g* is decreased. As a result, the retainers 88 and the regulating buttons are rotated in the counter clockwise direction. This results in that the distance between the toes 20*n* and the regulating buttons 87 is reduced.

As will be understood, the regulating screws 27*f* projects from the brackets 29*a* into the space in front of the array of action mechanisms 20, and the tuner completes the tuning work speedy.

In the above-described embodiments, each of the hammer assemblies 25, the regulating bar 27*c* and the regulating button 87 and the regulating screw 27*f* serve as a beating member, a regulating member and a manipulator, respectively. The shank flange rail 26 is corresponding to a stationary member, and the shaft 28*a* serves as a supporting member. The toe 20*n* and the bump 20*p* serve as a first portion of the jack and a second portion of the jack, respectively.

Although particular embodiments of the present invention have been shown and described, it will be apparent to those skilled in the art that various changes and modifications may be made without departing from the spirit and scope of the present invention.

The present invention may appertain to other kinds of keyboard musical instrument. The acoustic piano 10 may be a standard upright piano, and an automatic playing system may be further incorporated in the silent piano.

The regulating bars 27*c* may be replaced with a single regulating bar shared among the jacks 20*g* of all the action mechanisms 20. The present invention does not set any limit to the total number of second regulating bars 27*c*.

The shaft 28*a* may be attached to the shank flange rail 26 by means of more than two bearing units.

The tandem regulating button mechanism according to the present invention may be incorporated in the keyboard musical instruments, which are fabricated on the basis of upright pianos.

Another linear motion-to-rotation converting mechanism may be employed in the tandem regulating button mechanism 27/82. For example, a flexible coupling such as, for example, a coil spring may be directly inserted between the head portion 29*p* and the arm member 28*t*.

The linear motion-to-rotation converting mechanism may be replaced with another kind of converting mechanism. For example, a rod, which is rotatably connected to the arm member 28*t*, may be directly connected to the retainer 28*d*/28*e* in such a manner as to project frontwardly. A tuner pushes and pulls the rod for adjusting the regulating bars 27*c* to the appropriate positions.

The regulating buttons 87 may be respectively supported by the retainers 88 so as to permit a tuner to adjust the individual regulating buttons 87 to the appropriate positions by means of the adjusting mechanisms 85 respectively associated with the regulating buttons 87.

An automatic playing system may be further incorporated in the standard grand piano and the silent piano. The automatic playing system includes plural actuators respectively associated with the black/white keys, and the actuators are selectively energized for moving the associated black/white keys without fingering of a human player on the keyboard.

What is claimed is:

1. A regulating mechanism associated with a jack incorporated in an action mechanism forming a part of a keyboard musical instrument, comprising:

a regulating member provided for said jack so as to permit said jack to escape from a beating member of said keyboard musical instrument when said jack is brought into contact with said regulating member;

a supporting member connected to a stationary member of said keyboard musical instrument;

a retainer connected to said regulating member, and movably supported by said supporting member; and an adjusting mechanism connected between said supporting member and said retainer for changing a relative position between said supporting member and said retainer, and having a manipulator projecting into a free space formed in said keyboard musical instrument and manipulated by a tuner for changing a gap between said regulating member and said jack through a relative motion between said retainer and said supporting member.

2. The regulating mechanism as set forth in claim 1, in which said action mechanism is provided over one end portion of a key so as to be actuated when said key is moved, and said free space is created over the other end portion of said key.

3. The regulating mechanism as set forth in claim 1, in which said adjusting mechanism includes another stationary member fixed to said supporting member, and said manipulator is connected between said another stationary member and said retainer so as to vary a gap therebetween when said tuner manipulates said manipulator.

4. The regulating mechanism as set forth in claim 3, in which said retainer is rotatably supported by said supporting member, and said adjusting mechanism further includes a rotatable member rotatably connected to said retainer in such a manner as to have a rotational axis offset from a rotational axis of said retainer, and said manipulator is connected at one end thereof to said another stationary member and at the other end thereof to said rotatable member.

5. The regulating mechanism as set forth in claim 4, in which said manipulator is a regulating screw, and said regulating screw has a threaded stem portion connected to a threaded hole formed in said another stationary member and a head portion secured to said rotatable member.

6. The regulating mechanism as set forth in claim 5, in which said threaded stem portion projects through said another stationary member into said free space produced over a front portion of a key, and said key is connected to said action mechanism provided over a rear portion thereof.

7. A silent system incorporated in a keyboard musical instrument having plural keys, plural action mechanisms respectively connected to said plural keys and arranged in a lateral direction and plural beating members respectively actuated by said plural action mechanisms through first escapes of jacks forming parts of said plural action mechanism for striking plural vibratory members when first portions of said jacks are brought into contact with a primary regulating member, comprising:

a stopper provided for said plural beating members, and changed between a free position provided out of trajectories of said plural beating members for permitting said plural beating members to strike said plural vibratory members and a blocking position provided on said trajectories for causing said plural beating members to rebound thereon before striking said plural vibratory members;

a secondary regulating member changed between an active position provided on trajectories of second portions of said jacks and related to said blocking position and an inactive position provided out of said trajectories of said second portions and related to said free position, and producing second escapes faster than said first escapes when said second portions are brought into contact therewith;

a supporting member provided in the vicinity of said secondary regulating member, and connected to a stationary member of said keyboard musical instrument;

a retaining member connected to said secondary regulating member, and movably supported by said supporting member; and an adjusting mechanism connected between said supporting member and said retaining member for changing a relative position between said supporting member and said retaining member, and having a manipulator projecting into a free space formed in said keyboard musical instrument and manipulated by a tuner for varying a distance between said second portions and said secondary regulating member through changing said relative position.

8. The silent system as set forth in claim 7, in which said manipulator projects in a fore-and-aft direction perpendicular to said lateral direction so as to enter into said free space created over front portions of said plural keys, and said plural action mechanisms are provided over rear portions of said plural keys.

9. The silent system as set forth in claim 7, in which said adjusting mechanism includes another stationary member fixed to said supporting member, and said manipulator is connected between said another stationary member and said retaining member so as to vary a gap therebetween when said tuner manipulates said manipulator.

10. The silent system as set forth in claim 9, in which said retaining member is rotatably supported by said supporting member, and said adjusting mechanism further includes a rotatable member rotatably connected to said retaining member in such a manner as to have a rotational axis offset from a rotational axis of said retaining member, and said manipulator is connected at one end thereof to said another stationary member and at the other end thereof to said rotatable member.

11. The silent system as set forth in claim 10, in which said manipulator is a regulating screw, and said regulating screw has a threaded stem portion connected to a threaded hole formed in said another stationary member and a head portion secured to said rotatable member.

12. The silent system as set forth in claim 11, in which said threaded stem portion projects through said another stationary member into said free space created over front portions of said plural keys, and said plural keys are respectively connected to said plural action mechanisms provided over rear portions thereof.

13. A keyboard musical instrument having a fore-and-aft direction and a lateral direction perpendicular to said fore-and-aft direction, comprising:

a keyboard having plural keys selectively moved by a player positioned in front of said keyboard;

plural action mechanisms provided over a rear portion of said keyboard so as to create a free space over a front portion of said keyboard, connected to said keys so as to be selectively actuated by the keys moved by said player, and having jacks and a primary regulating member for producing first escapes of said jacks when first portions of said jacks are brought into contact with said primary regulating member;

plural beating members respectively driven for rotation by said plural action mechanisms when said first escapes or second escapes are produced;

plural vibratory members respectively struck with said plural beating members at the end of said rotation;

a secondary regulating member opposed to second portions of said jacks, and producing said second escape when said second portions are brought into contact therewith;

a supporting member connected to a stationary member;

a retaining member connected to said secondary regulating member, and movably supported by said supporting member so as to change a relative position therebetween; and an adjusting mechanism connected between said secondary regulating member and said supporting member for changing said relative position, and having a manipulator projecting into said free space and manipulated for changing a distance between said second portions and said secondary regulating member by changing said relative position.

14. The keyboard musical instrument as set forth in claim 13, in which said adjusting mechanism includes another stationary member fixed to said supporting member, and said manipulator is connected between said another stationary member and said retaining member so as to vary a gap therebetween when said tuner manipulates said manipulator.

15. The keyboard musical instrument as set forth in claim 14, in which said retaining member is rotatably supported by said supporting member, and said adjusting mechanism further includes a rotatable member rotatably connected to said retaining member in such a manner as to have a rotational axis offset from a rotational axis of said retaining member, and said manipulator is connected at one end thereof to said another stationary member and at the other end thereof to said rotatable member.

16. The keyboard musical instrument as set forth in claim 15, in which said manipulator is a regulating screw, and said regulating screw has a threaded stem portion connected to a threaded hole formed in said another stationary member and a head portion secured to said rotatable member.

17. The keyboard musical instrument as set forth in claim 16, in which said threaded stem portion projects through said another stationary member into said free space so that a tuner rotates said regulating screw at a part of said threaded stem portion projecting from said another stationary member.

18. The keyboard musical instrument as set forth in claim 13, in which said keyboard, said plural action mechanism, said plural beating members and said plural vibratory members are arranged as similar to a keyboard, plural action mechanisms, plural hammers and plural sets of strings incorporated in a grand piano.

19. The keyboard musical instrument as set forth in claim 13, further comprising a stopper changed between a free position provided out of trajectories of said plural beating members so as to permit said plural beating members to strike said plural vibratory members and a blocking position provided on said trajectories so as to cause said plural beating members to rebound thereon before striking said plural vibratory members, and said secondary regulating member is changed between an inactive position provided out of trajectories of said second portions and related to said free position and an active position provided on said trajectories of said second portions and related to said blocking position.

20. The keyboard musical instrument as set forth in claim 19, in which said adjusting mechanism includes another stationary member fixed to said supporting member, and said manipulator is connected between said another stationary member and said retaining member so as to vary a gap therebetween when said tuner manipulates said manipulator.

21. The keyboard musical instrument as set forth in claim 20, in which said retaining member is rotatably supported by said supporting member, and said adjusting mechanism further includes a rotatable member rotatably connected to said retaining member in such a manner as to have a rotational axis offset from a rotational axis of said retaining member, and said manipulator is connected at one end thereof to said another stationary member and at the other end thereof to said rotatable member.

22. The keyboard musical instrument as set forth in claim 21, in which said manipulator is a regulating screw, and said regulating screw has a threaded stem portion connected to a threaded hole formed in said another stationary member and a head portion secured to said rotatable member.

23. The keyboard musical instrument as set forth in claim 19, in which said keyboard, said plural action mechanism, said plural beating members and said plural vibratory members are arranged as similar to a keyboard, plural action mechanisms, plural hammers and plural sets of strings incorporated in a grand piano.

24. A keyboard musical instrument having a fore-and-aft direction and a lateral direction perpendicular to said fore-and-aft direction, comprising:

a keyboard having plural keys arranged in said lateral direction, and selectively moved by a player positioned in front of said keyboard;

plural action mechanisms arranged in said lateral direction over a rear portion of said keyboard so as to create a free space over a front portion of said keyboard, connected to said keys so as to be selectively actuated by the keys moved by said player, and having jacks and a primary regulating member for producing first escapes of said jacks when first portions of said jacks are brought into contact with said primary regulating member;

plural hammers arranged in said lateral direction over said plural action mechanisms, and respectively driven for rotation by said plural action mechanisms when said first escapes or second escapes are produced;

plural strings respectively struck with said plural hammers at the end of said rotation;

a secondary regulating member extending in said lateral direction in such a manner as to be opposed to second portions of said jacks, and producing said second escape when said second portions are brought into contact therewith;

a supporting member connected to a stationary member;

a retaining member fixed to said secondary regulating member, and rotatably supported by said supporting member so as to change a relative angular position therebetween; and an adjusting mechanism including a stationary bracket fixed to said supporting member, a movable member rotatably connected to said retaining member in such a manner as to have a rotational axis offset from a rotational axis of said retaining member and a manipulator extending in said fore-and-aft direction, connected at one end thereof to said rotatably member and engaged at the other end portion thereof with said stationary bracket in such a manner as to project from said stationary bracket into said free space.

25. The keyboard musical instrument as set forth in claim 24, further comprising a stopper changed between a free position provided out of trajectories of said plural hammers so as to permit said plural hammers to strike said plural sets of strings and a blocking position provided on said trajectories so as to cause said plural hammers to rebound thereon before striking said plural hammers, and said secondary regulating member is changed between an inactive position provided out of trajectories of said second portions and related to said free position and an active position provided on said trajectories of said second portions and related to said blocking position.

* * * * *